US011533802B1

(12) United States Patent
Gaber et al.

(10) Patent No.: US 11,533,802 B1
(45) Date of Patent: Dec. 20, 2022

(54) DIRECT-CURRENT PLASMA TORCH APPARATUS

(71) Applicants: Janak H Handa, Toronto (CA); Hossam Gaber, North York (CA)

(72) Inventors: Hossam Gaber, North York (CA); Mustafa Abdalmejeed Mansour Aldeeb, Oshawa (CA)

(73) Assignees: Janak H. Handa, Toronto (CA); Hossam Gaber, North York (CA)

( * ) Notice: Subject to any disclaimer, the term of this patent is extended or adjusted under 35 U.S.C. 154(b) by 0 days.

(21) Appl. No.: 17/660,402

(22) Filed: Apr. 23, 2022

(51) Int. Cl.
*H05H 1/28* (2006.01)

(52) U.S. Cl.
CPC ..... *H05H 1/28* (2013.01)

(58) Field of Classification Search
CPC ..... H05H 1/28
USPC ..... 313/231.41
See application file for complete search history.

(56) References Cited

U.S. PATENT DOCUMENTS 5,416,296 A * 5/1995 Walters ..... H05H 1/28 219/121.52
5,841,095 A * 11/1998 Lu ..... H05H 1/38 219/121.48
2014/0238861 A1* 8/2014 Foret ..... B23K 10/00 204/660
2015/0319835 A1* 11/2015 Sanders ..... B23K 10/00 219/121.48
2020/0058474 A1* 2/2020 Fong ..... H01J 37/32568

* cited by examiner

*Primary Examiner* — Christopher M Raabe
(74) *Attorney, Agent, or Firm* — Aird & McBurney LP

(57) ABSTRACT

In an aspect, a direct-current plasma torch apparatus is provided. The plasma torch apparatus includes first and second electrodes and an insulating body, where the electrodes are electrically connected to an external power source to generate an arc discharge between the first and second electrodes. The plasma torch apparatus can be configured as a modular torch apparatus for simple removal and replacement of elements of the plasma torch apparatus. The plasma torch apparatus can also be configured as a cooled plasma torch apparatus to prolong the working life of elements of the plasma torch apparatus.

25 Claims, 11 Drawing Sheets

DIRECT-CURRENT PLASMA TORCH APPARATUS

FIELD OF THE DISCLOSURE

The present invention relates generally to plasma arc producing torches. In particular, the invention relates to a direct-current plasma torch apparatus.

FIELD OF THE DISCLOSURE

Various configurations of plasma-generating torches or systems are used in the incineration of waste and other undesirable products within plasma furnaces. Atmospheric pressure thermal plasma jets generated in direct current (dc) arc plasma torches are particularly useful in these furnaces, as well as in a number of other applications including plasma processing, surface modifications, spray coatings, and material synthesis. The application of direct-current plasma torches within these plasma furnaces present many benefits to the overall function of the system, as the direct-current plasma torches tend to have less flickers on the lines, produce less noise, produce less wear on the refractory liners of the furnace, and allow for better power control.

In the function of a direct-current torch, the choice of the electrodes used in the torch, as well as the choice of other components in the arc heater, greatly impact the resulting performance of the torch for the specific application for which the plasma torch will be used. In certain applications, consumable electrodes (for example, carbon, graphite, or metal) may be acceptable or even desirable, whereas in other applications, extreme care must be exercised to avoid contamination of the processed material by the electrodes. In such cases, the use of non-consumable electrodes is preferable. Unfortunately, the erosion of electrodes is one of the most important problems in the design and construction of the plasma torch, which occurs due to the arc collision and the high temperature of the plasma.

There are several known methods in the art for slowing the degradation of the electrodes in direct-current plasma torches. For example, an external magnetic field or swirl of the gas at the inlet can be used to rotate the arc of plasma. The plasma swirl produces a constant arc movement as generated by the torch, and reduces the rate of erosion of the electrodes. It is known in the art that the degree of gas spin will influence the formation and stability of the plasma arc structure. For example, the gas can be introduced through a pipe, where the angle of the tube will affect the gas rotation on the plasma structure. It is also known to provide a cooling system that directly cools the electrodes within the direct-current torch. For example, many commercial DC torches use a water circulation system to directly cool the electrodes.

It is desirable to provide a direct current torch with an increased throughput, while also providing an efficient cooling system for the torch to reduce or slow the erosion of the electrodes by plasma. It is also beneficial to provide a direct-current torch that could be used in a reactor chamber of a plasma furnace, where the electrodes of the direct-current torch are modular and can easily be replaced without substantially disassembling the torch. However, none of these known methods provide a significant reduction in the life of the electrodes in high-power direct-current plasma torches.

It is therefore an object of the invention to provide a novel direct-current plasma torch apparatus and system for use of the apparatus.

SUMMARY

According to an aspect, there is provided a direct-current plasma torch apparatus comprising a torch housing defining a torch chamber therewithin and including an inlet end, an outlet end, and at least one gas inlet positioned to inject at least one plasma forming gas into the torch chamber, along a wall of the torch housing, to produce a vortex flow of the at least one plasma forming gas, the torch chamber including a top chamber section and a lower, conical chamber section that is shaped to accelerate the at least one plasma forming gas along the torch chamber towards the outlet end of the torch housing. The plasma torch apparatus also comprises a first electrode being positioned at a tapered end of the lower, conical chamber section, an insulating body, and a second electrode being mounted within the insulating body and extending along at least a portion of the torch chamber to define an arc gap between the first electrode and the second electrode, at least one of the first and second electrodes being connected to a power source for generation of an arc discharge therebetween, across the arc gap.

According to another aspect, there is provided a direct-current plasma torch apparatus comprising: a torch housing defining a torch chamber therewithin, the torch housing including an inlet end with a through-opening, an outlet end, and at least one gas inlet for injecting at least one plasma forming gas into the torch chamber. The plasma torch apparatus also comprises a first electrode being positioned at the outlet end of the torch housing and including a through-aperture that defines an outlet for the at least one plasma forming gas, a removable second electrode being removably securable within the through-opening of the inlet end so as to permit removal of the second electrode therethrough, when removably secured within the through-opening, the removable second electrode extending along at least a portion of the reaction chamber towards the first electrode to define an arc gap therebetween, at least one of the first and removable second electrodes being connected to a power source for generation of an arc discharge therebetween, across the arc gap, and an insulating body being disposed around the second electrode and being mounted to the inlet end of the torch housing.

According to another aspect, there is provided a direct-current plasma torch apparatus comprising: a torch housing defining a torch chamber therewithin, the torch housing including an inlet end, an outlet end, and at least one gas inlet for injecting at least one plasma forming gas into the torch chamber. The plasma torch apparatus also comprises a first electrode being positioned at the outlet end of the torch housing and including a through-aperture that defines an outlet for the at least one plasma forming gas, an insulating body being mounted to the inlet end of the torch housing, and a modular second electrode being disposed within the insulating body and extending along at least a portion of the reaction chamber towards the first electrode, the modular second electrode including an electrode tip that is releasably secured on a distal end thereof, an arc gap being defined between the electrode tip and the first electrode, at least one of the first and modular second electrodes being connected to a power source for generation of an arc discharge between the first and second electrodes, across the arc gap.

According to another aspect, there is provided a direct-current plasma torch apparatus comprising: a cooled torch housing defining a torch chamber and at least one cooling chamber therewithin, the cooled torch housing including an inlet end, an outlet end, at least one gas inlet for injecting at least one plasma forming gas into the torch chamber, at least one cooling inlet, and at least one cooling outlet, the torch chamber including a conical chamber section, the cooling inlet and the cooling outlet being in fluid communication with the at least one cooling chamber for circulation therethrough of at least one cooling fluid, where the at least one cooling chamber is defined between the cooled torch housing and the conical chamber section such that a transverse dimension of the at least one cooling chamber increases towards the outlet end, along a length of the cooled torch housing. The plasma torch apparatus also comprises a first electrode being positioned at a tapered end of the lower, conical chamber section and including a through-aperture that defines an outlet for the at least one plasma forming gas, an insulating body; and a second electrode being mounted within the insulating body and extending along at least a portion of the torch chamber towards the first electrode to define an arc gap between therebetween, at least one of the first and second electrodes being connected to a power source for generation of an arc discharge therebetween, across the arc gap.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1:
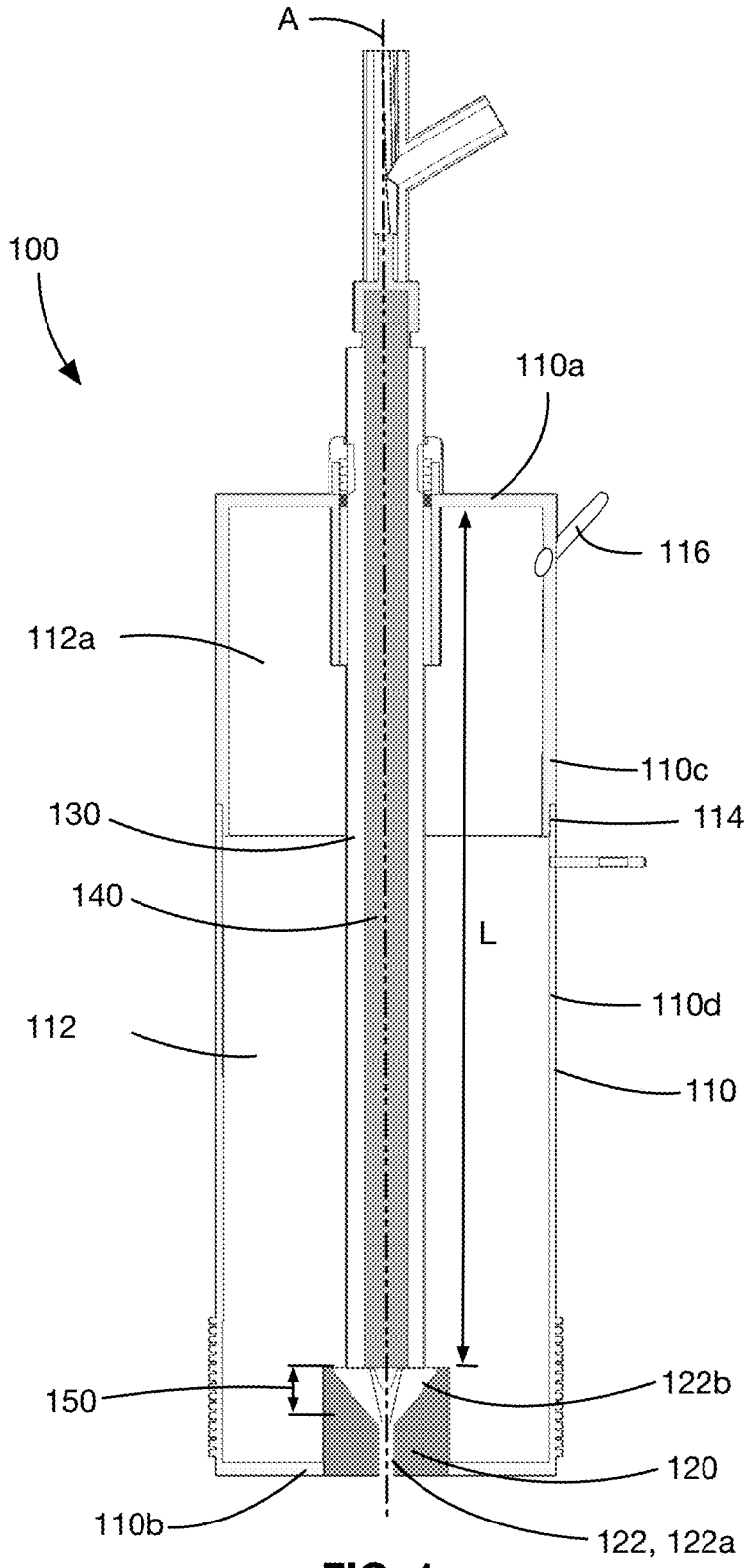
FIG. 1 shows a side, section-view of a general embodiment of the direct-current, plasma torch apparatus.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

The indefinite article "a" is not intended to be limited to mean "one" of an element. It is intended to mean "one or more" of an element, where applicable, (i.e. unless in the context it would be obvious that only one of the element would be suitable).

Any reference to upper, lower, top, bottom or the like are intended to refer to an orientation of a particular element during use of the claimed subject matter and not necessarily to its orientation during shipping or manufacture. The upper surface of an element, for example, can still be considered its upper surface even when the element is lying on its side.

In a general embodiment shown in FIG. 1, the direct-current, plasma torch apparatus (referred to hereinafter as the plasma torch apparatus 100) comprises a torch housing 110 that defines a torch chamber 112 therewithin, and includes an inlet end 110*a*, an outlet end 110*b*, and at least one gas inlet 116 positioned to inject at least one plasma forming gas into the torch chamber 112. The plasma torch apparatus 100 also includes a first electrode 120 that is positioned towards the outlet end 110*b* of the torch housing 110 and includes a through-aperture 122 which defines an outlet for the at least one plasma forming gas. The plasma torch apparatus 100 further includes an insulating body 130 connected to the inlet end 110*a* of the torch housing 110, and a second electrode 140 that is mounted within the insulating body 130 and extends along at least a portion of the torch chamber 112, towards the outlet end 110*b* of the torch housing 110. The second electrode 140 extends towards the outlet end 110*b* to define an arc gap 150 between the first electrode 120 and the second electrode 140, where at least one of the first and second electrodes 120, 140 is electrically connected to an external power source for generation of an arc discharge between the first electrode 120 and the second electrode 140, across the arc gap 150.

In an embodiment, the first electrode 120, second electrode 140 and insulating body 130 collectively define an electrode assembly of the plasma torch apparatus.

In an embodiment, the at least one plasma forming gas is any one of an oxygen-containing gas, a mixture of oxygen-containing gases, or a mixture of water vapor and inert gases. It is generally preferable to have a composition of the at least one plasma forming which has a very low amount of oxygen or water vapor contamination.

In an embodiment, the at least one plasma forming gas is a plurality of plasma forming gases.

In the embodiments where the at least one plasma forming gas includes a plurality of plasma forming gases, the gas inlet 116 of the torch housing 110 can include a plurality of gas inlets, where each of the plurality of gas inlets corresponds to one of the plurality of plasma forming gases. In the specific embodiment provided in FIG. 2, the gas inlet 116 is a multi-gas inlet 216. The multi-gas inlet 216 includes three separate nozzles 218 that each connect to a source of a unique plasma forming gas to provide three different plasma forming gases into a mixing chamber 214 of the gas inlet 216. The three separate plasma forming gases are combined within the mixing chamber 214 and are injected into the torch chamber 112, through an outlet conduit 220 of the mixing chamber 214.

In an embodiment, the first electrode 120 and the second electrode 140 are composed of an electrically conductive material including, but not limited to copper, nickel, graphite, stainless steel, tungsten, low-carbon steel and mixtures or alloys thereof. In some embodiments, the first electrode 120 and second electrode 140 are composed of the same conductive material. In other embodiments the first electrode 120 and second electrode 140 are composed of different conductive materials.

In various embodiments of the plasma torch apparatus 100 as disclosed herein, the torch housing 110 and electrode assembly can have various physical forms or arrangements to provide various benefits to the performance of the plasma torch apparatus 100.

In an embodiment, the first electrode 120 defines an anode of the electrode assembly and the second electrode 140 defines a cathode of the electrode assembly.

In an embodiment, the material of the first and second electrodes 120, 140 are selected to optimize the performance of the electrode assembly for different applications of the torch at different temperature, current and power levels.

In an exemplary embodiment where the second electrode 140 is a hot cathode, the arc current is in range from 1000 A to 6000 A, and the second electrode 140 is composed of pure tungsten or tungsten with a dopant. In this embodiment, the dopant can be various metal-oxide additives including $ThO_2$ at 2% by weight, $Y_2O_3$ at 2% by weight, $CeO_2$ at 2% by weight, $La_2O_3$ at 2% by weight, or $LaB_6$ at between 0.1 to 0.2% by weight. In an alternate, exemplary embodiment where the second electrode 140 is a hot cathode, the arc current is 300 A and the second electrode 140 is be composed of one of zirconium and hafnium.

In an exemplary embodiment where the second electrode 140 is a cold cathode, the second electrode 140 is composed of pure (oxygen-free) copper. In an alternate embodiment, the second electrode 140 is a cold cathode composed of copper doped with chromium at 2% by weight.

In an embodiment where the first electrode 120 is the anode of the electrode assembly, the first electrode 120 is composed of copper with silver alloys. In this embodiment, the at least one plasma forming gas is preferably a pure oxygen plasma gas.

In an additional, exemplary embodiment where the temperature of the plasma arc produced by the plasma torch apparatus 100 will be at least 2000K, the first electrode 120 is the anode of the electrode assembly, and is composed of pure copper with tungsten inserts.

In an embodiment, the insulating body 130 is a dielectric insulating body. The insulating body 130 can be composed of an insulating material such as a ceramic insulator. In the specific embodiment provided in FIG. 1, the insulating body 130 is composed of a ceramic insulator that is quartz glass.

In an embodiment, the second electrode 140 is concentrically mounted within the insulating body 130, where the second electrode 140 has a cylindrical form and the insulating body 130 has a tubular form.

In an additional embodiment, the second electrode 140 is shaped and mounted within the insulating body 130 such that the insulating body 130 extends along an entire length of the second electrode 140 that is extending along the torch chamber 112.

Figure 2:
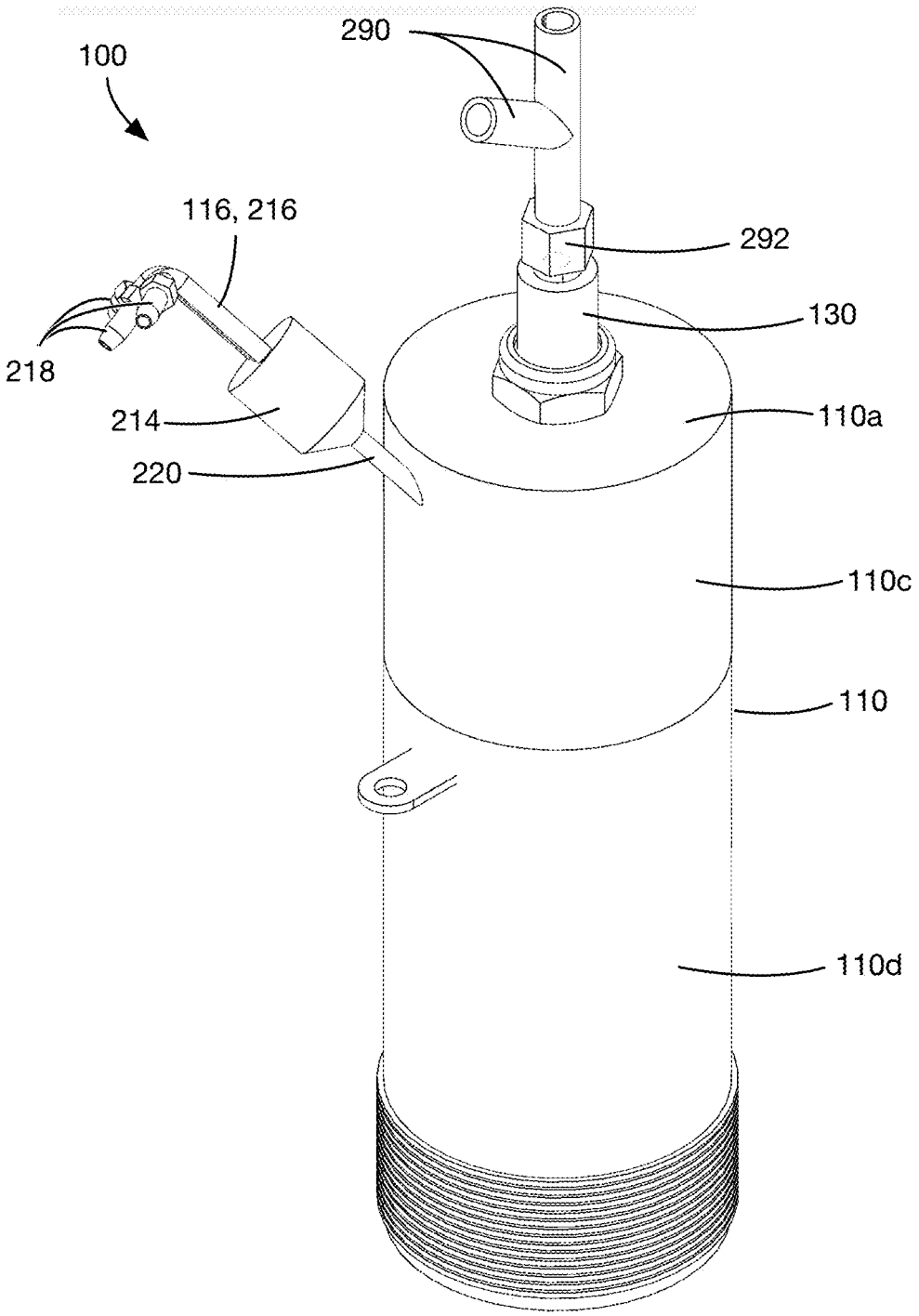
FIG. 2 shows an isometric view of a general embodiment of the plasma torch apparatus including a multi-inlet, gas inlet.

In the specific embodiments provided in FIGS. 1 and 2, the second electrode 140 is shaped as a rod. In this embodiment, the insulating body 130 has a tubular form, and is sized such that the insulating body 130 concentrically surrounds and is in contact with an outer surface of the second electrode 140. The insulating body 130 and second electrode 140 may extend along the same length (L) into the torch chamber 112 of the torch housing 110.

In an additional embodiment, the first electrode 120 has a cylindrical form, where the through-aperture 122 of the first electrode 120 has an at least partially conical form that tapers towards the outlet end 110*b* of the torch housing 110. In the specific embodiment shown in FIG. 1, the through-aperture 122 of the first electrode 120 includes an upper conical aperture portion 122*b* and a lower cylindrical aperture portion 122*a*.

In an embodiment, the first electrode 120 is mounted towards the outlet end 110*b* of the torch housing 110 and the second electrode 140 is connected to the inlet end 110*a* of the torch housing 110 such that a longitudinal axis of the first electrode 120 is coaxial to a longitudinal axis (A) of the second electrode 140. In the specific embodiment provided in FIG. 1, the first electrode is mounted through the outlet end 110*b* of the torch housing 110, and the second electrode is mounted through the inlet end 110*a* of the torch housing 110. The second electrode 140 and first electrode 120 are coaxially aligned along the longitudinal axis (A) of the second electrode 140, where the second electrode 140 has a cylindrical form.

In the embodiment provided in FIGS. 1 and 2, the torch housing 110 includes at least a top housing portion 110*c* and a bottom housing portion 110*d*, which respectively define a top chamber section 112*a* and a lower chamber section 112*b* of the torch chamber 112. The top housing portion 110*c* and bottom housing portion 110*d* may be removably connectable to each other through various suitable mating structures 114, including a pair of corresponding threads on each of the top and bottom housing portions 110*c*, 110*d* as shown in FIG. 1.

In the specific embodiment provided in FIGS. 1 and 2, the torch housing 110 has a cylindrical form, where the inlet end

110*a* is a top circular surface of the cylindrical housing and the outlet end 110*b* is a bottom circular surface of the cylindrical housing. In this embodiment, the top and bottom housing portions 110*c*, 110*d* are each cylindrically shaped and collectively form the torch housing 110.

In an embodiment, the torch housing 110 is composed of a metal material with a high thermal stability such as stainless steel.

Torch Apparatus with Conical Chamber Section

Figure 3:
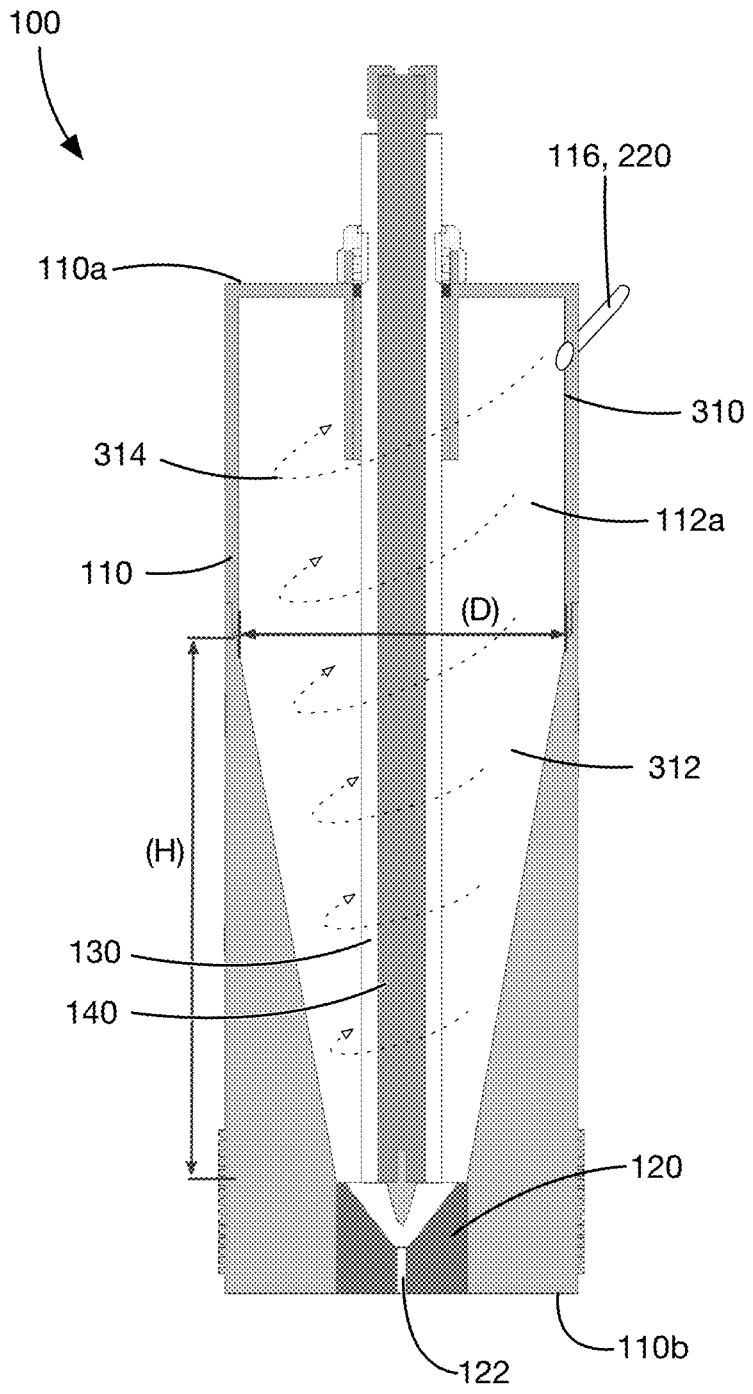
FIG. 3 shows a side, section-view of an embodiment of the plasma torch apparatus that will produce a vortex flow of the at least one plasma forming gas.
Figure 4:
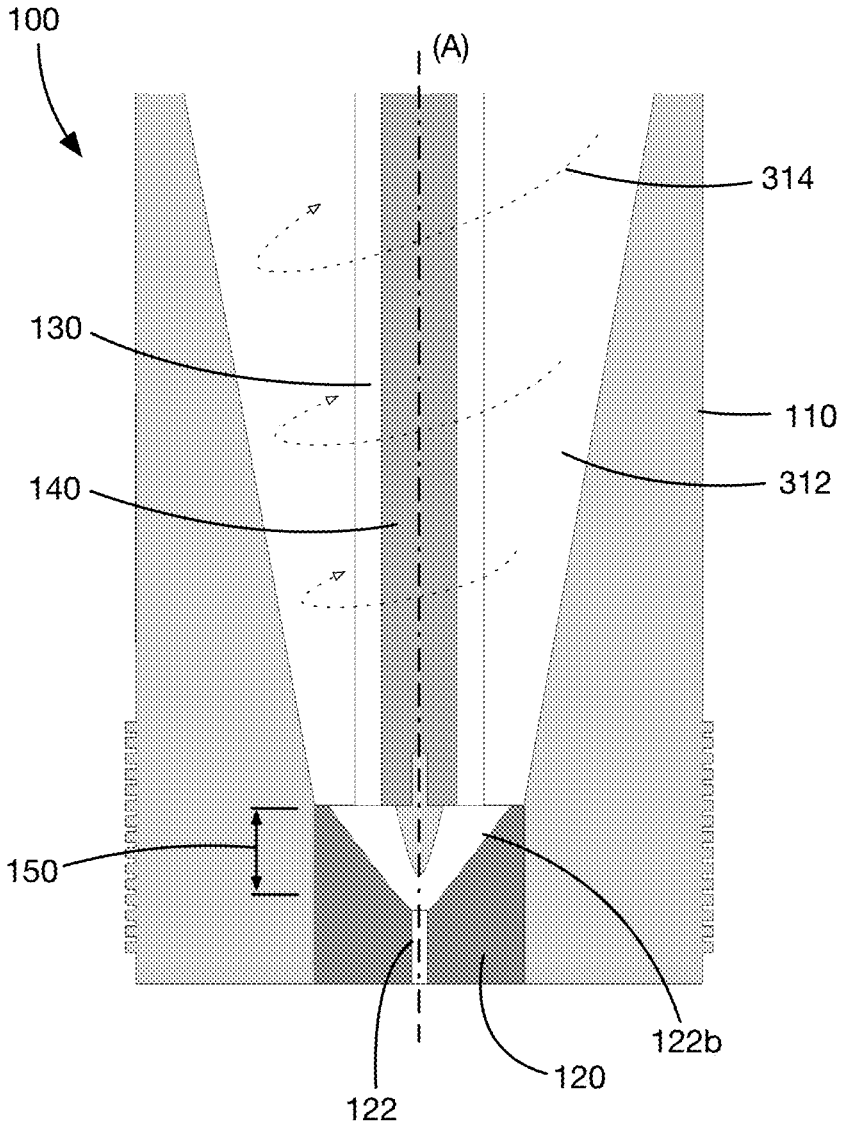
FIG. 4 shows a side, section-view of the embodiment of the plasma torch apparatus in FIG. 3 including a conical chamber section for accelerating the at least one plasma forming gas through the torch chamber.

In an embodiment such as the embodiment provided in FIGS. 3 and 4, the plasma torch apparatus 100 comprises the torch housing 110 which defines the torch chamber 112 therewithin. As described previously, the torch housing 110 includes the inlet end 110*a*, the outlet end 110*b*, and the at least one gas inlet 116 positioned to inject at least one plasma forming gas into the torch chamber 112. In this embodiment, the at least one gas inlet 116 is positioned to inject the at least one plasma forming gas into the torch chamber 112, along a wall 310 of the torch housing, to produce a vortex flow 314 of the at least one plasma forming gas within the torch chamber 112. In this embodiment, the torch chamber 112 includes a top chamber section 112*a* and a lower, conical chamber section 312, where the lower, conical chamber section 312 is shaped to accelerate the at least one plasma forming gas along the torch chamber 112 towards the outlet end 110*b* of the torch housing 110. In this embodiment, the first electrode 120 is positioned towards the outlet end 110*b* of the torch housing 110 such that the first electrode 120 is positioned at a tapered end of the lower, conical chamber section 312. Again, the first electrode 120 includes the through-aperture 122 that defines the outlet for the at least one plasma forming gas. The insulating body 130 is connected to the inlet end 110*a* of the torch housing 110, and the second electrode 140 is mounted within the insulating body 130 and extends along at least a portion of the torch chamber 112 to define the arc gap 150 between the first electrode 120 and the second electrode 140.

In the specific embodiment provided in FIGS. 3 and 4, the torch housing 110 is a torch housing 110 having a cylindrical form, where the torch housing 110 includes the separable first and second housing portions 110*c*, 110*d* which define a top chamber section 112*a* and a lower, conical chamber section 312 of the torch chamber 112. The second housing portion 110*d* includes the lower, conical chamber section 312 and the first housing portions 110*c* include the top chamber section 112*a*. As shown in FIG. 3, the top chamber section 112*a* of the torch chamber 112 in the torch housing 110 can have a cylindrical form. In this embodiment, the outlet conduit 220 of the at least one gas inlet 116 is mounted through the torch housing 110 at an angle relative to the wall 310 of the torch housing 110 such that the at least one plasma forming gas is injected along the wall 310 of the torch housing 110. As the at least one plasma forming gas is injected along the wall 310 of the torch housing 110, it will form the vortex flow 314 of the at least one plasma forming gas within the torch chamber. In this embodiment, the first electrode 120 is mounted through the outlet end 110*b* of the torch housing 110, at the tapered end of the lower, conical chamber section 312.

In an additional embodiment, the outlet conduit 220 of the at least one gas inlet 116 is positioned to inject the at least one plasma forming gas along the wall 310 of the torch housing 110 such that the at least one plasma forming gas is injected into the torch chamber 112 in an orientation that is substantially tangential to the wall 310 of the torch housing 110.

In an embodiment, the outlet conduit 220 of the at least one gas inlet 116 is mounted through the torch housing 110 such that the vortex flow 314 of the at least one plasma forming gas is a stable vortex flow within the torch chamber 112.

In the embodiments of the plasma torch apparatus 100 that include the lower, conical chamber section 312, the lower, conical chamber section 312 is provided to accelerate the vortex flow 314 of the at least one plasma forming gas such that an angular speed of the at least one plasma forming gas increases along the lower, conical section 312, towards the outlet end 110*b* of the torch housing 110. By accelerating the vortex flow 314 of the at least one plasma forming gas along a portion of torch chamber 112, towards the outlet end 110*b* of the torch housing 110, the plasma torch apparatus 110 throughput is increased. Due to the increased throughput, the resulting plasma arc power of the plasma torch apparatus 110 is also increased.

In the specific embodiment provided in FIGS. 3 and 4, the lower, conical chamber section 312 is in an inverted conical form such that it tapers along the length of the lower housing portion 110*d*, towards the outlet end 110*b* of the torch housing 110. The inverted, conical form of the lower, conical chamber section 312 accelerates the vortex flow 314 of the at least one plasma forming gas through the torch housing 110. The lower, conical chamber section 312 will also concentrate the plasma density of the resulting plasma arc discharge between the first and second electrodes 120, 140 by concentrating and narrowing the flow of the at least one plasma forming gas as the at least one plasma forming gas flows towards the tapered end of the lower, conical chamber section 312. In this specific embodiment, the first electrode 120 includes the through-aperture 122 that has an at least partially conical portion 122*b* that tapers towards the outlet end 110*b* of the torch housing 110, where the at least partially conical portion 122*b* further accelerates the at least one plasma forming gas through the torch housing 110.

In an embodiment, the lower, conical chamber section 312 is formed such that a diameter (D) of the lower, conical chamber section 312 is half the height (H) of the lower, conical chamber section 312.

Embodiments with Movable or Removable Elements

Figure 5:
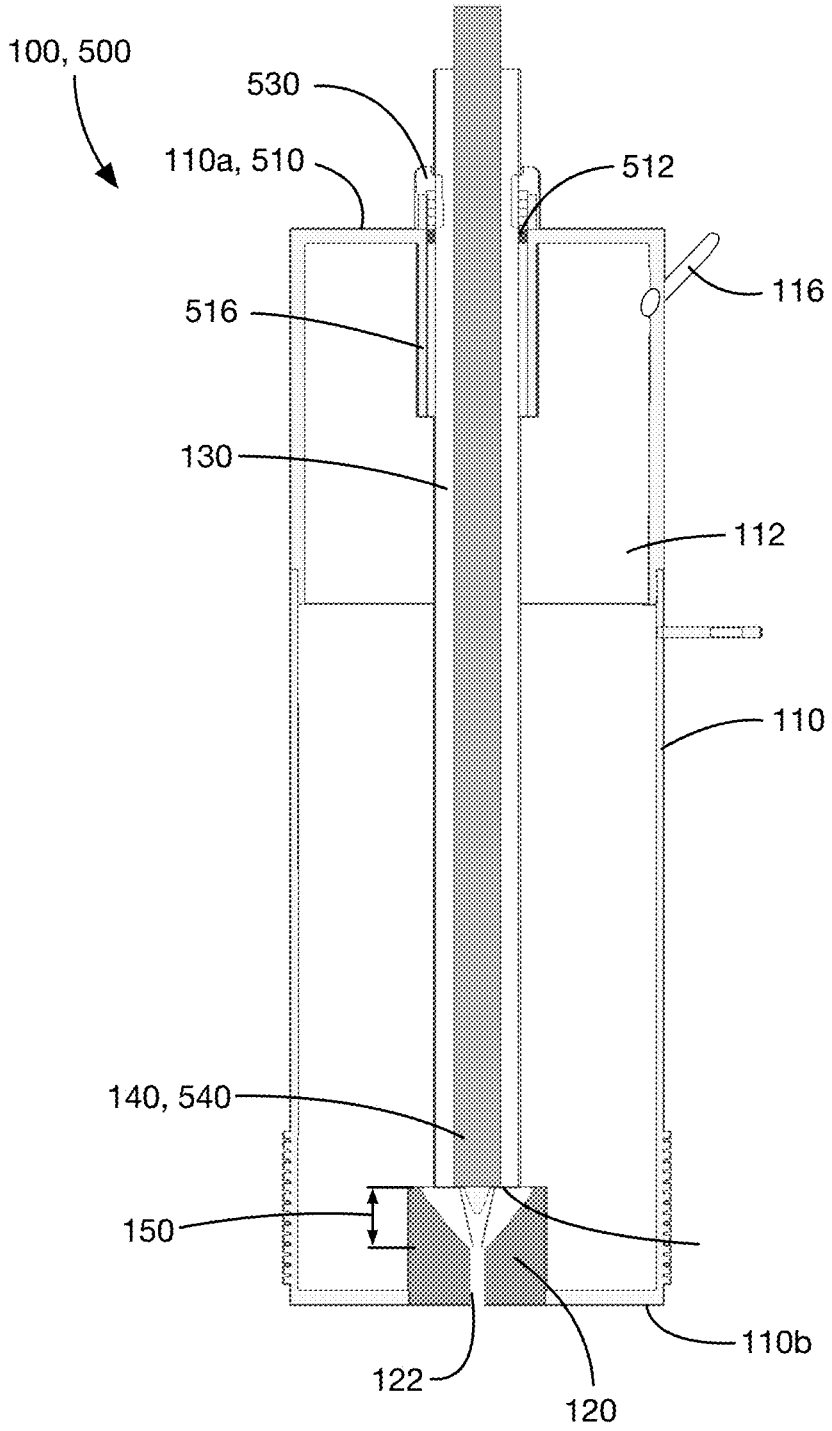
FIG. 5 shows a side, section-view of a modular embodiment of the plasma torch apparatus where at least one of the first electrode, second electrode or electrode assembly can be removed from the plasma torch apparatus.
Figure 6A:
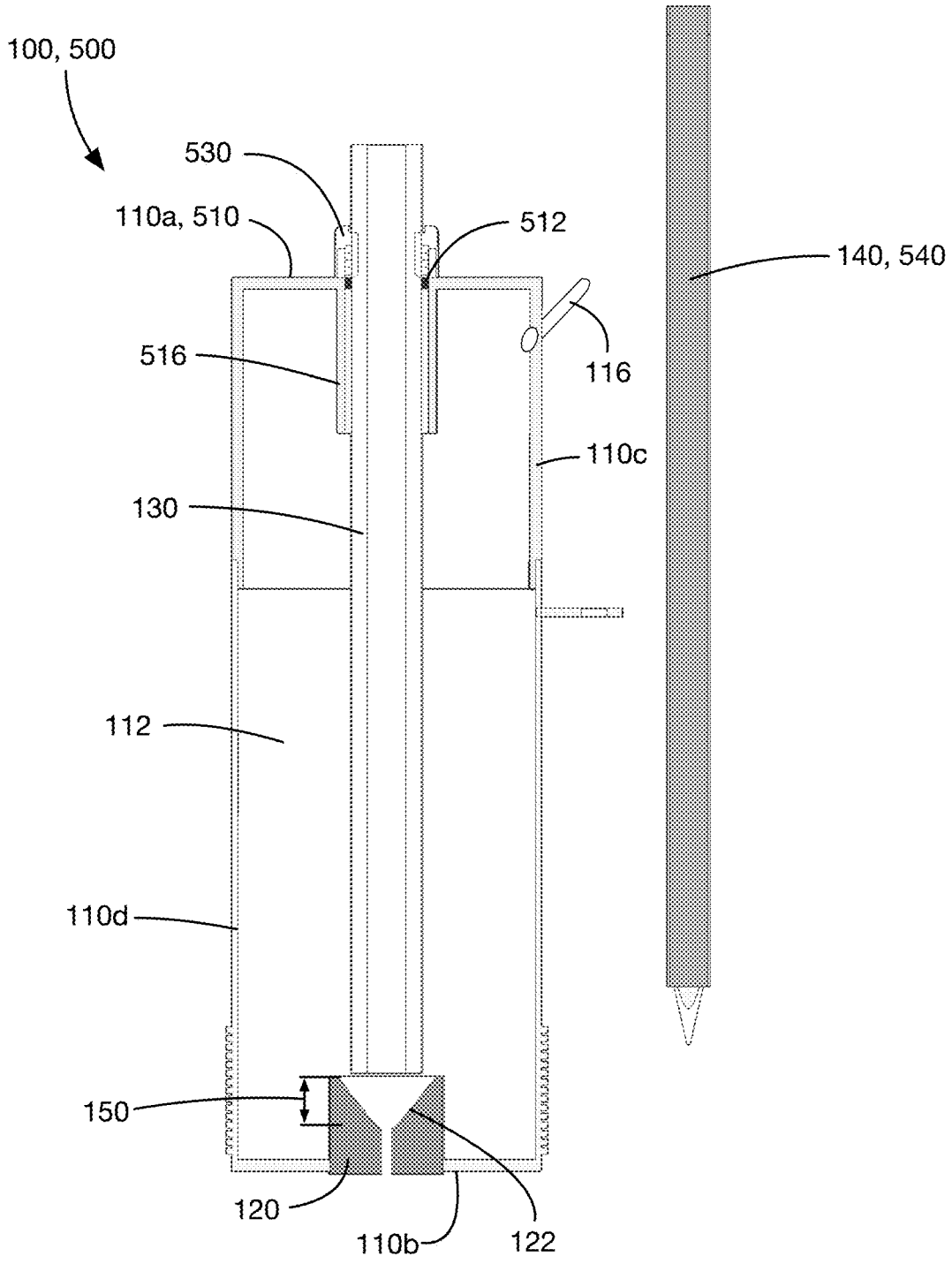
FIG. 6A shows a side, section-view of a modular embodiment of the plasma torch apparatus where the second electrode is a removable second electrode.
Figure 6B:
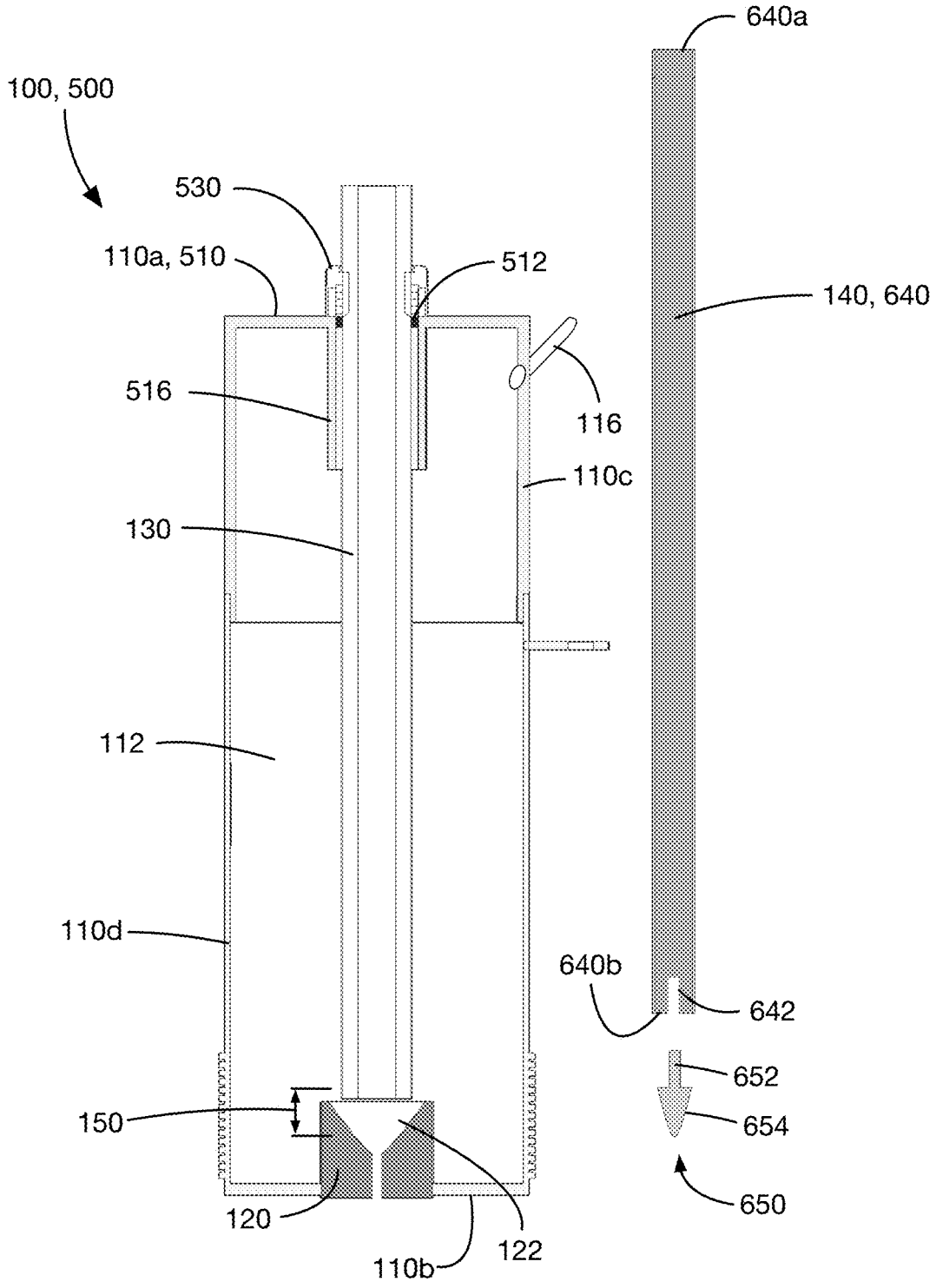
FIG. 6B shows a side, section-view of a modular embodiment of the plasma torch apparatus where the second electrode is a modular second electrode with a separable electrode tip.
Figure 6C:
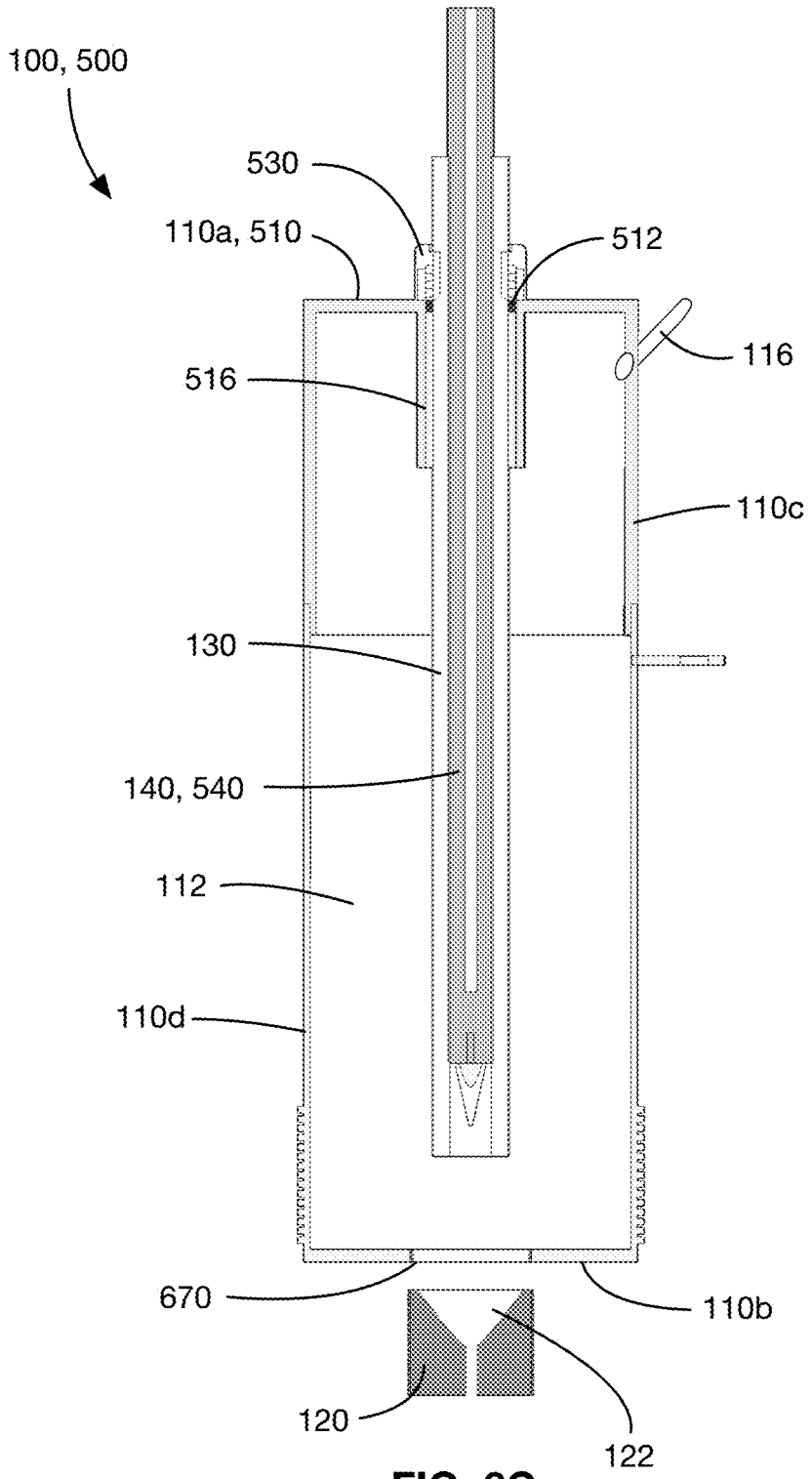
FIG. 6C shows a side, section-view of a modular embodiment of the plasma torch apparatus where the first electrode is a removably securable to a mounting aperture of the torch housing.
Figure 6D:
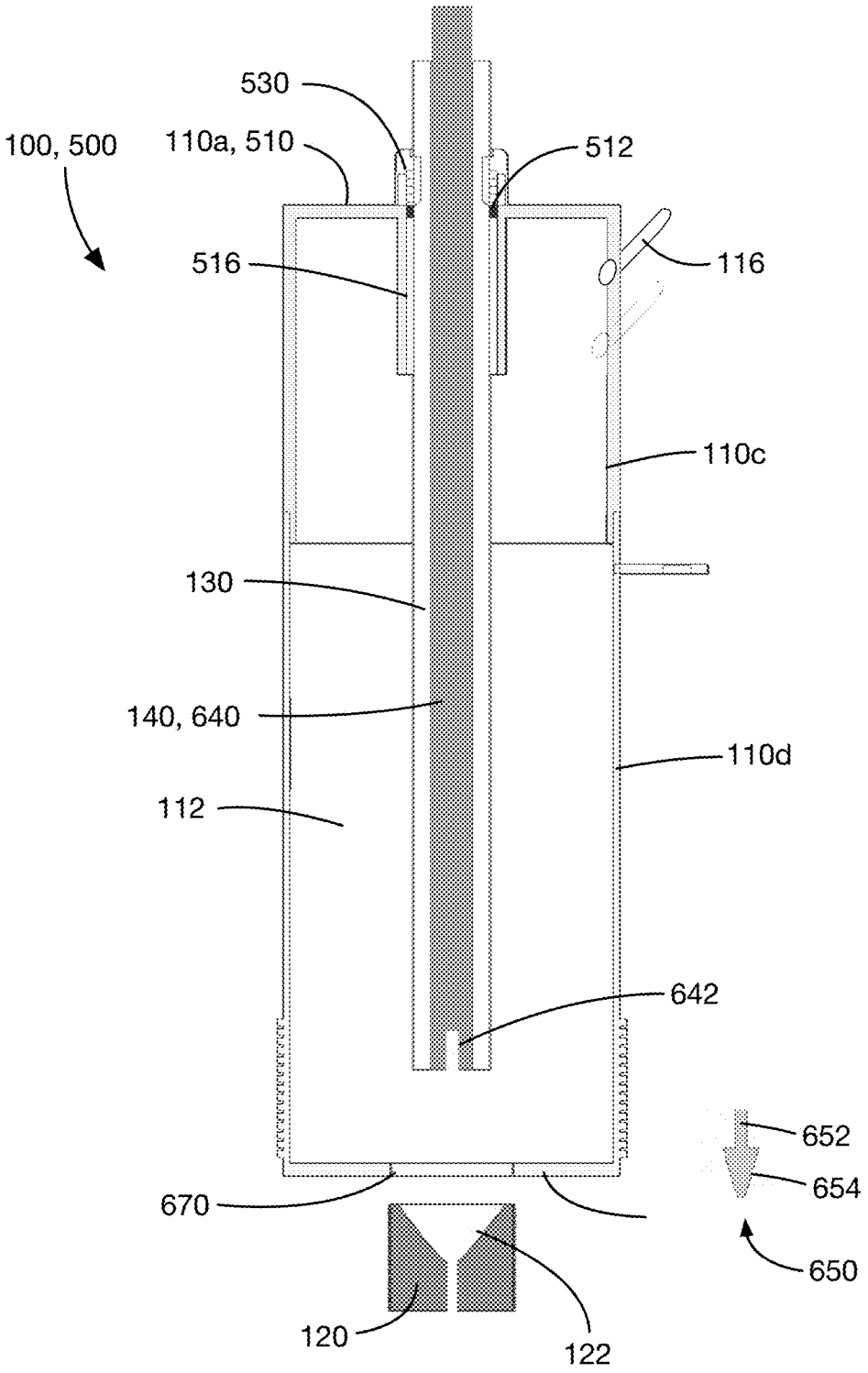
FIG. 6D shows a side, section-view of a modular embodiment of the plasma torch apparatus where the first electrode is a removable from the torch housing such that the electrode tip can be removed from the modular second electrode.
Figure 6E:
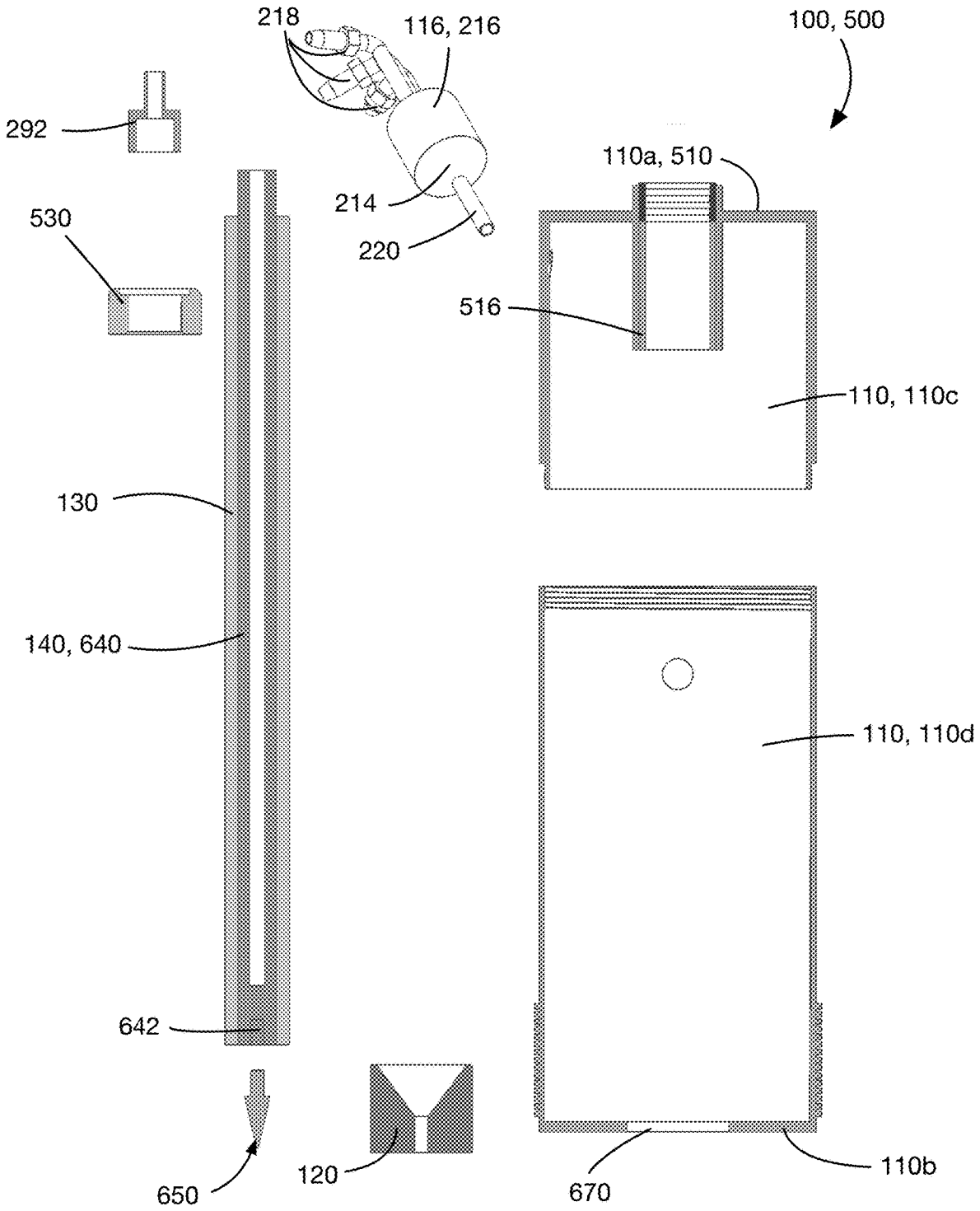
FIG. 6E shows a side, section-view of a modular embodiment of the plasma torch apparatus where all of the components are removed, and the plasma torch apparatus is fully disassembled.

In an embodiment of the plasma torch apparatus as shown in FIGS. 5 to 6E, the plasma torch apparatus 100 is a modular plasma torch apparatus 500. In this embodiment, the modular plasma torch apparatus 500 is formed such that at least one of the first electrode 120, second electrode 140 or electrode assembly are removably securable within the torch housing 110. In this embodiment, the torch housing 110 and one of the first electrode 120, second electrode 140 or electrode assembly are correspondingly fashioned such that the one of the first electrode 120, second electrode 140 and electrode assembly can be removed from the torch housing 100 without having to disassemble the torch housing 110. As shown in FIG. 6E, the torch housing 110 and components of the modular plasma torch apparatus 500 including the first electrode 120, second electrode 140 and insulating body 130 can all be removed from the torch housing 110, where the top housing portion 110*c* and bottom housing portion 110*d* that makeup the torch housing 110 are separated to fully disassembly the plasma torch apparatus 500.

In an embodiment of the modular plasma torch apparatus 500 as shown in FIG. 5, the modular plasma torch apparatus 500 comprises the torch housing 110 which defines the torch chamber 112 therewithin and includes the inlet end 110*a* where the inlet end 110*a* is an inlet end 510 with a through-opening 512, the outlet end 110*b*, and the at least one gas inlet 116 for injecting the at least one plasma forming gas into the torch chamber 112. The modular plasma torch apparatus 500 also includes the first electrode 120 positioned at the outlet end 110*b* of the torch housing 110 (where the first electrode 120 includes the through-aperture 122) and a second electrode assembly. As shown in FIG. 6A, the modular plasma torch apparatus 500 includes the insulating body 130 as described previously, and a second electrode 140 that is a removable second electrode 540, where the removable second electrode 540 is removably securable within the through-opening 512 of the inlet end 510 of the torch housing 110 so as to permit removal of the removable second electrode 540 therethrough, from the torch chamber 112. When the removable second electrode 540 is removably secured within the through-opening 512 of the inlet end 510, the removable second electrode 540 extends along at least a portion of the torch chamber 112 towards the first electrode 120 to define the arc gap 150 therebetween. At least one of the first electrode 120 and removable second electrode 540 is connected to an external power source for the generation of an arc discharge therebetween, across the arc gap 150.

In the specific embodiment provided in FIGS. 5 and 6A, the modular plasma torch apparatus 500 has a torch housing 110 with a cylindrical form. A top surface of the cylindrical form of the torch housing 110 defines the inlet end 510 thereof. The through-opening 512 of the inlet end 510 is a circular through-opening, where a tubular flange 516 of the torch housing 110 surrounds the through-opening 512 and projects into the torch chamber 112 to support the insulating body 130 and the second electrode 140. The modular plasma torch apparatus 500 includes the insulating body 130 as described previously, where the insulating body 130 is mounted through the through-opening 512 of the inlet end 510. As shown in FIG. 6A, the removable second electrode 540 is rod-shaped, and is removably securable within the through-opening 512 of the inlet end 510 of the torch housing 110 so as to permit extraction (See FIG. 6A) of the removable second electrode 540 through the through-opening 512 of the inlet end 510 of the torch housing 110. In this embodiment of the modular plasma torch apparatus 500, the first electrode 120 is positioned at the outlet end 110*b* of the torch housing 110.

In the embodiment shown in FIGS. 5 to 6D, the insulating body 130 includes a mounting structure 530 connected to a proximal end of the insulating body 130, where the mounting structure 530 is shaped to secure the insulating body 130 and the removable second electrode 540 within the through-opening 512 of the inlet end 510 of the torch housing 110. In this embodiment, the removable second electrode 540 is releasably secured to the mounting structure 530 of the insulating body 130 such that the insulating body 130 and removable second electrode 540 can be separated while the insulating body 130 remains connected in the mounting structure 530. In this way, the removable second electrode 540 can be connected to detached from the plasma torch apparatus 500 via the mounting structure 530. In an additional embodiment, the removable second electrode 540 is releasably secured to the mounting structure 530 such that only a portion of the removable second electrode 540 extends through the through-opening 512 of the inlet end 510 of the torch housing 110 and into the torch chamber 112.

In an embodiment, the removable second electrode 540 is a movable relative to the torch chamber 112 when the removable second electrode 540 is secured in the mounting structure 530. In this embodiment, the removable second electrode 540 is releasably secured to the mounting structure 530 so that the second electrode 540 can be moved between a first position to define a first size of arc gap between the second electrode 540 and the first electrode 120 for electric arc ignition, and in a second position, after electric arc ignition, at a greater distance from the first electrode 120 to provide a stable plasma in the torch chamber 112.

In an alternate embodiment of the modular plasma torch apparatus 500, the insulating body 130 of the modular plasma torch apparatus 500 is also removably securable within the through-opening 512 of the inlet end 510 of the torch housing 110 so as to permit removal of the insulating body 130 from the torch chamber 112. In this embodiment, the mounting structure 530 can be formed such that the insulating body 130 is separable therefrom, where the mounting structure 530 stays mounted to the torch housing 110 while the insulating body is detached from the torch housing 110.

In an embodiment of the modular plasma torch apparatus 500 as shown in FIG. 6B, the modular plasma torch apparatus 500 includes the torch housing 110 which defines the torch chamber 112 therewithin, where the torch housing 110 includes the inlet end 510 with a through-opening 512, the outlet end 110*b*, and the at least one gas inlet 116 for injecting the at least one plasma forming gas into the torch chamber 112. In this embodiment of the modular plasma torch apparatus 500, the modular plasma torch apparatus 500 also includes the first electrode 120 positioned at the outlet end 110*b* of the torch housing 110, the insulating body 130 which is mounted to the inlet end 510 of the torch housing 110, and the second electrode 140 which is disposed within the insulating body 130 and extends along at least a portion of the torch chamber 112 towards the first electrode 120. In this embodiment, the second electrode 140 is a modular second electrode 640. The modular second electrode 640 includes an electrode tip 650 that is releasably mounted on a distal end 640*b* of the modular second electrode 640, where the arc gap 150 of the modular plasma torch apparatus 500 is defined between the electrode tip 650 and the first electrode 120. At least one of the first electrode 120 and modular second electrode 640 is connected to the external power source for generation of an arc discharge between the first electrode 120 and the and the electrode tip 640, across the arc gap 150.

In the specific embodiment provided in FIG. 6B, the torch housing 110 has a cylindrical form, and the top surface of the cylindrical form of the torch housing 110 defines the inlet end 510 thereof. The circular through-opening 512 of the inlet end 510 includes the tubular flange 516 of the housing 110 that surrounds the through-opening 512. The modular plasma torch apparatus 500 includes the insulating body 130 as described previously, where the insulating body 130 is mounted via a mounting structure 530, through the through-opening 512 of the inlet end 510 of the torch housing 110. As shown in FIG. 6B, the modular second electrode 640 can be rod-shaped, and can be removably securable within the through-opening 512 of the inlet end 510 of the torch housing so as to permit removal (See FIG. 6A) of the modular second electrode 640 therethrough. In an alternate embodiment of the modular second electrode 640, the modular second electrode is fixedly mounted through the inlet end 510 of the plasma torch housing 110 such that only the electrode tip 650 can be removed from the torch chamber 112 of the torch housing 110.

In an embodiment of the modular plasma torch apparatus 500, the modular second electrode 640 includes proximal and distal ends 640*a*, 640*b*, where the distal end 640*b* of the modular second electrode 640 includes a bore 642. The bore 642 on the distal end 640*b* of the modular second electrode 640 is sized to receive and hold a mating protrusion 652 of the electrode tip 650. In the specific embodiment provided in FIG. 6B, the electrode tip 650 includes the mating protrusion 652 and a conical, end portion 654. When the mating protrusion 652 of the second electrode tip 650 is secured in the bore 642 of the modular second electrode 640, the electrode tip 650 is securely mounted to the modular second electrode 640, and the conical, end portion 654 of the tip 650 extends beyond the distal end 640*b* of the modular second electrode 640.

In an additional embodiment, the bore 642 of the modular second electrode 640 and the mating protrusion 652 of the electrode tip 650 have corresponding threads for securing the electrode tip 650 to the distal end 640*b* of the second electrode 640

The end portion of the electrode tip 650 can have various forms. For example, the end portion of the electrode tip 650 may have a conical form, a cylindrical form, or a form with a flat end face.

In an embodiment, the electrode tip 650 is formed of conductive material such as copper or stainless steel. The electrode tip 650 can be composed of the same material as the rest of modular second electrode 640 or the electrode tip 650 can be composed of a different material than that of the modular second electrode 640.

In an embodiment of the plasma torch apparatus 500 such as the embodiment in FIG. 6C, the outlet end 110*b* of the torch housing 110 includes a mounting aperture 670. In this embodiment, the first electrode 120 is formed to be removably mounted within the mounting aperture 670 of the outlet end 110*b* so that the first electrode 120 can be secured within and detached from the torch housing 110 of the plasma torch apparatus 500.

In the specific embodiment provided in FIG. 6C, the torch housing 110 has a cylindrical form, and an outlet end 110*b* of the torch housing 110 includes the mounting aperture 670 having a circular form. The first electrode 120 having a cylindrical form is formed such that an outer surface of the first electrode 120 and an inner surface of the mounting aperture 670 have a set of corresponding mounting elements to facilitate removable mounting of the first electrode 120 in the mounting aperture 670. In an exemplary embodiment, the mounting elements of first electrode 120 and mounting aperture 670 is a pair of corresponding threads on each.

In an alternate embodiment of the modular plasma torch apparatus 500 as shown in FIG. 6D, the modular plasma torch apparatus 500 is formed such that the modular second electrode 640 is fixedly mounted through the through-opening 512 of the inlet end 510 of the torch housing 110, and the electrode tip 650 is removably securable to the modular second electrode 640. In this embodiment shown in FIG. 6D, the outlet end 110 of the torch housing includes the mounting aperture 670, and the second electrode 140 is the modular second electrode 640 with the electrode tip 650. In this embodiment, the modular second electrode 640 is mounted within the through-opening 512 of the inlet end 510 of the torch housing 110. In this embodiment, the electrode tip 650 can be removed from the modular second electrode 640 by first removing the first electrode 120 from the mounting aperture 670. Once the first electrode 120 is removed from the mounting aperture 670, the distal end 640*b* of the modular second electrode 640 can be accessed through the mounting aperture 670 to remove the electrode tip 650 from the distal end 640*b* of the second electrode 640.

In a further embodiment where the modular plasma torch apparatus 500 is mounted within a larger reactor unit such as a plasma furnace, the modular plasma torch apparatus 500 is formed so that one of the first electrode 120, second electrode 140 or electrode assembly can be removed from the torch housing 110 without removing the modular plasma torch apparatus 500 from the larger reactor unit.

Cooled Torch

In an embodiment of the plasma torch apparatus 100, the plasma torch apparatus 100 is a cooled plasma torch apparatus 700 which includes an integrated cooling system. The cooling system within the cooled plasma torch apparatus 700 functions to prolong the working life of various components in the cooled plasma torch apparatus 700 including the first and second electrodes 120, 140. The cooling system of the cooled plasma torch apparatus 700 prolongs the operating life of these components by stabilizing the plasma arc that is produced by the cooled plasma torch apparatus 700. By stabilizing the plasma arc, the plasma is concentrated towards the center of the torch chamber 112, which slows the rate of degradation of the components in the cooled plasma torch apparatus 700.

Figure 7:
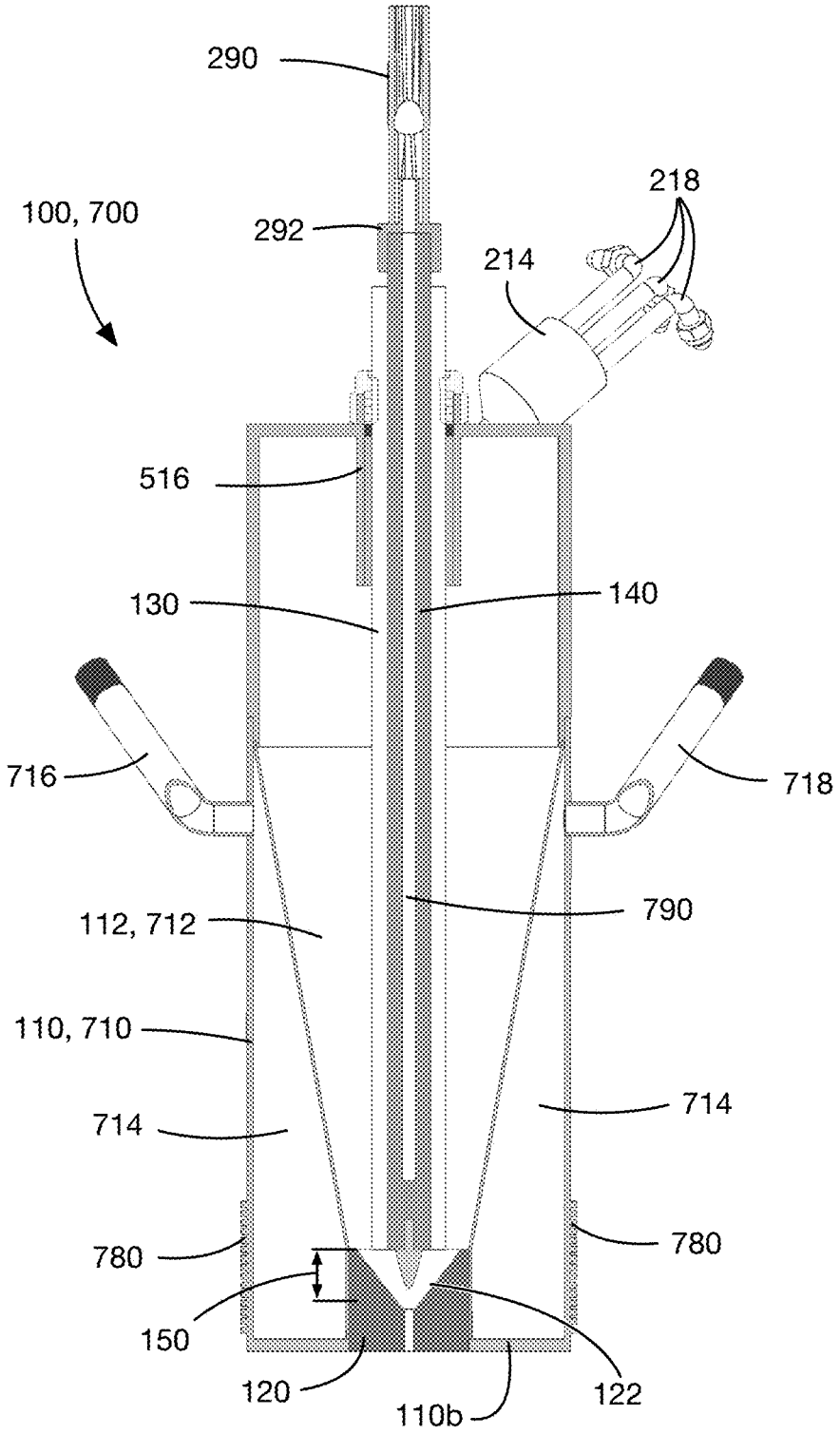
FIG. 7 shows a side, section-view of an embodiment where the plasma torch apparatus is a cooled plasma torch apparatus including a cooling system for circulating at least one cooling medium.

In an embodiment such as the embodiment provided in FIG. 7, the cooled plasma torch apparatus 700 comprises a torch housing 110 that includes the inlet end 110*a*, the outlet end 110*b*, and at least one gas inlet for injecting the at least one plasma forming gas into the torch chamber 112 of the torch housing 110, where the torch chamber 112 includes at least a conical chamber 712. In an embodiment, this conical chamber 712 is the lower, conical chamber section 312 as described previously. In this embodiment of the cooled plasma torch apparatus 700, the torch housing 110 is a cooled torch housing 710 that defines the torch chamber 112 and at least one cooling chamber 714 therewithin, the cooled torch housing 710 includes at least one cooling inlet 716, and at least one cooling outlet 718. The cooling inlet 716 and the cooling outlet 718 of the cooled torch housing 710 are in fluid communication with the at least one cooling chamber 714 within the cooled torch housing 710 to provide a circulation therethrough of at least one cooling fluid. In this embodiment, the at least one cooling chamber 714 is defined within the cooled torch housing 710, between the cooled torch housing 710 and at least a portion of the conical chamber 712 such that a transverse dimension of the at least one cooling chamber 714 increases along a length of the torch housing 710, towards the outlet end 110*b* thereof. In this embodiment, the cooled plasma torch apparatus 700 also includes the first electrode 120, where the first electrode is positioned at a tapered end of the conical chamber 712, the insulating body 130, and the second electrode 140 that is mounted within the insulating body 130, and extends along at least a portion of the torch chamber 112 towards the first electrode 112 to define the arc gap 150 therebetween.

In an embodiment where the cooled torch housing 710 has a cylindrical form, the transverse dimension of the at least one cooling chamber 714 is a radial dimension of the at least one cooling chamber 714 relative to the cooled torch housing 710.

In the specific embodiment provided in FIG. 7, the cooled torch housing 710 has a cylindrical form. The cooled torch housing 710 defines a conical chamber 712 in a lower portion of the cooled torch housing 710, and one cooling chamber 714. The one cooling chamber 714 is defined between a side-wall of the cooled torch housing 710 that has a cylindrical form and a wall of the conical chamber 712 in the lower portion of the cooled torch housing 710. The transverse dimension of the one cooling chamber 714 is in a radial direction relative to the cooled torch housing 710 having the cylindrical form. The radial size of the one cooling chamber 714 increases along a length of the cooled torch housing 710, towards the outlet end 110*b* of the cooled torch housing 710, and then stays constant when the cooling chamber is extending around the first electrode 120. As shown in FIG. 7, the at least one cooling inlet 716, and at least one cooling outlet 718 are mounted towards a top end of the one cooling chamber 714 and are in fluid communication with the one cooling chamber 714 to circulate the at least one cooling fluid.

In an embodiment, at least a portion of an outer surface of the cooled torch housing 710 includes at least one cooling fin 780 that is conductively connected to the outer surface of the cooled torch housing 710.

In the specific embodiment provided in FIG. 7, the cooled torch housing 710 has a cylindrical form, and the at least one cooling fin 780 is a plurality of circumferential cooling fins that extend around the outer surface of the cooled torch housing 710 and are positioned in a stacked configuration around a bottom section of the outer surface of the cooled torch housing 710.

In an additional embodiment, the cooling system of the cooled plasma torch apparatus 700 further includes a cooling sub-system for directly cooling at least one of the first and second electrodes 120, 140 of the cooled plasma torch apparatus. In an embodiment, the second electrode 140 includes a cooling bore 790 extending along a portion of the length of the second electrode 140, where the cooling bore 790 is formed to circulate at least one cooling fluid along at least a portion of the length of the second electrode 140.

Referring to FIGS. 2 and 7, the cooling bore 790 of the second electrode can be in fluid communication with at least one cooling conduit 290, where the at least one cooling conduit 290 is in fluid communication with the cooling bore 790 for circulation therethrough of at least one cooling medium. In the specific embodiments provided in FIGS. 2 and 7, the cooling conduit 290 is mounted directly on top of the second electrode 140 via a mounting adapter 292.

In an embodiment, the plasma torch apparatus 100 is an assembly that includes some or all of the elements of the plasma torch apparatus 100, modular plasma torch apparatus 500, and cooled plasma torch apparatus 700 in one total plasma torch apparatus.

In general, the use of the phrase "along the length of" is intended to mean "in the axial direction".

The above-described embodiments are intended to be examples of the present invention and alterations and modifications may be effected thereto, by those of skill in the art, without departing from the scope of the invention that is defined solely by the claims appended hereto.

What is claimed is:

1. A direct-current plasma torch apparatus, comprising:

a torch housing defining a torch chamber therewithin and including an inlet end, an outlet end, and at least one gas inlet positioned to inject at least one plasma forming gas into the torch chamber, along a wall of the torch housing, to produce a vortex flow of the at least one plasma forming gas, the torch chamber including a top chamber section and a lower, conical chamber section that is shaped to accelerate the at least one plasma forming gas along the torch chamber towards the outlet end of the torch housing;

a first electrode being positioned at a tapered end of the lower, conical chamber section;

an insulating body; and a second electrode being mounted within the insulating body and extending along at least a portion of the torch chamber to define an arc gap between the first electrode and the second electrode, at least one of the first and second electrodes being connected to a power source for generation of an arc discharge therebetween, across the arc gap, wherein the torch housing further defines at least one cooling chamber, the cooling chamber including a cooling inlet and a cooling outlet for the circulation of at least one cooling fluid through the cooling chamber, wherein the first electrode is positioned in an opening of the outlet end of the torch housing that is defined by an inner wall of the torch housing, and wherein the cooling chamber surrounds the inner wall of the torch housing so as to cool the first electrode through the inner wall.

2. The direct-current plasma torch apparatus of claim 1, wherein the first electrode includes a through-aperture that defines an outlet from the torch chamber for the at least one plasma forming gas at the outlet end of the torch housing.

3. The direct-current plasma torch apparatus of claim 2, wherein the through-aperture of the first electrode has a conical portion that tapers in the direction of the outlet end of the torch housing.

4. The direct-current plasma torch apparatus of claim 1, wherein the torch housing has a cylindrical form, and wherein the at least one gas inlet positioned to inject the at least one plasma forming gas along the wall of the torch housing is oriented such that the at least one gas one plasma forming gas is ejected substantially tangential to the wall of the torch housing.

5. The direct-current plasma torch apparatus of claim 1, wherein the lower, conical chamber section is formed such that a diameter (D) of the lower, conical chamber section is half the height (H) of the lower, conical chamber section.

6. The direct-current plasma torch apparatus of claim 1, wherein the first electrode has a tubular form, the insulating body has a tubular form, and the second electrode has a cylindrical form, wherein the second electrode is concentrically mounted within the insulating body.

7. The direct-current plasma torch apparatus of claim 1, wherein the at least one plasma forming gas is any one of an oxygen-containing gas, a mixture of oxygen-containing gases, or a mixture of water vapor and inert gases.

8. The direct-current plasma torch apparatus of claim 1, wherein the first electrode and the second electrode are composed of an electrically conductive material including but not limited to, copper, graphite, stainless steel, tungsten and mixtures or alloys thereof.

9. The direct-current plasma torch apparatus of claim 1, wherein the torch housing includes at least a top housing portion and a bottom housing portion which respectively define the top chamber section, and the lower, conical chamber section of the torch chamber, the top housing portion and the bottom housing portion being removably connectable to each other.

10. A direct-current plasma torch apparatus, comprising:

a torch housing defining a torch chamber therewithin, the torch housing including an inlet end, an outlet end, and at least one gas inlet for injecting at least one plasma forming gas into the torch chamber;

a first electrode being positioned at the outlet end of the torch housing and including a through-aperture that defines an outlet for the at least one plasma forming gas;

an insulating body including a through-aperture and being mounted through the inlet end of the torch housing; and a removable second electrode being removably securable within the through-aperture of the insulating body, where a portion of the second electrode extends beyond the inlet end of the torch housing to permit removal of the second electrode from the insulating body, through the inlet end of the torch housing, when removably secured within the through-aperture, the removable second electrode extending along at least a portion of the reaction chamber towards the first electrode to define an arc gap therebetween, at least one of the first and removable second electrodes being connected to a power source for generation of an arc discharge therebetween, across the arc gap; and.

11. The direct-current plasma torch apparatus of claim 10, wherein the insulating body includes a mounting structure on a proximal end thereof, where the mounting structure is shaped to secure the insulating body and the removable second electrode within the through-opening of the inlet end of the torch housing.

12. The direct-current plasma torch apparatus of claim 10, wherein the first electrode has a cylindrical form, the insulating body has a tubular form, and the removable second electrode has a cylindrical form, the removable second electrode being concentrically mounted within the insulating body.

13. The direct-current plasma torch apparatus of claim 10, wherein the at least one plasma forming gas is any one of an oxygen-containing gas, a mixture of oxygen-containing gases, or a mixture of water vapor and inert gases.

14. The direct-current plasma torch apparatus of claim 10, wherein the first electrode and the removable second electrode are composed of an electrically conductive material selected from the group of materials consisting of: copper, graphite, stainless steel, tungsten, mixtures thereof, and alloys thereof.

15. A direct-current plasma torch apparatus, comprising:

a torch housing defining a torch chamber therewithin, the torch housing including an inlet end, an outlet end having an opening, and at least one gas inlet for injecting at least one plasma forming gas into the torch chamber;

a first electrode being removably connected in the opening of the outlet end of the torch housing and including a through-aperture that defines an outlet for the at least one plasma forming gas;

an insulating body being mounted to the inlet end of the torch housing; and a modular second electrode being disposed within the insulating body and extending along at least a portion of the reaction chamber towards the first electrode, the modular second electrode including an electrode tip that is releasably secured on a distal end thereof such that the electrode tip is detachable through the opening of the outlet end once the first electrode is removed from the opening, an arc gap being defined between the electrode tip and the first electrode, at least one of the first and modular second electrodes being connected to a power source for generation of an arc discharge between the first and second electrodes, across the arc gap.

16. The direct-current plasma torch apparatus of claim 15, wherein the first electrode portion is releasably secured within the opening of the outlet end of the torch housing to facilitate removal of the first electrode portion from the torch housing.

17. The direct-current plasma torch apparatus of claim 15, wherein the first electrode has a cylindrical form, the insulating body has a tubular form, and the removable second electrode has a cylindrical form, the removable second electrode being concentrically mounted within the insulating body.

18. The direct-current plasma torch apparatus of claim 15, wherein the at least one plasma forming gas is any one of an oxygen-containing gas, a mixture of oxygen-containing gases, or a mixture of water vapor and inert gases.

19. The direct-current plasma torch apparatus of claim 15, wherein the first electrode and the removable second electrode are composed of an electrically conductive material selected from the group of materials consisting of: copper, graphite, stainless steel, tungsten, mixtures thereof, and alloys thereof.

20. A direct-current plasma torch apparatus, comprising:

a cooled torch housing defining a torch chamber and at least partially defining at least one cooling chamber, the cooled torch housing including an inlet end, an outlet end, at least one gas inlet for injecting at least one plasma forming gas into the torch chamber, at least one cooling inlet, and at least one cooling outlet, the torch chamber including a conical chamber section, the cooling inlet and the cooling outlet being in fluid communication with the at least one cooling chamber for circulation therethrough of at least one cooling fluid, where the at least one cooling chamber is defined between an outer wall of the cooled torch housing and an inner wall that defines the conical chamber section such that a transverse dimension of the at least one cooling chamber increases towards the outlet end, along a length of the cooled torch housing;

a first electrode being positioned at a tapered end of the lower, conical chamber section and including a through-aperture that defines an outlet for the at least one plasma forming gas;

an insulating body; and a second electrode being mounted within the insulating body and extending along at least a portion of the torch chamber towards the first electrode to define an arc gap between therebetween, at least one of the first and second electrodes being connected to a power source for generation of an arc discharge therebetween, across the arc gap.

21. The direct-current plasma torch apparatus of claim 20, wherein the outer wall of the cooled torch housing has a cylindrical form, and wherein the transverse dimension of the at least one cooling chamber is a radial dimension of the at least one cooling chamber relative to the torch housing.

22. The direct-current plasma torch apparatus of claim 20, wherein at least a portion of an outer surface of the cooled torch housing includes at least one cooling fin that is conductively connected to the outer surface of the cooled torch housing.

23. The direct-current plasma torch apparatus of claim 22, wherein the first electrode has a cylindrical form, the insulating body has a tubular form, and the removable second electrode has a cylindrical form, the removable second electrode being concentrically mounted within the insulating body.

24. The direct-current plasma torch apparatus of claim 20, wherein the at least one plasma forming gas is any one of an oxygen-containing gas, a mixture of oxygen-containing gases, or a mixture of water vapor and inert gases.

25. The direct-current plasma torch apparatus of claim 20, wherein the first electrode and the removable second electrode are composed of an electrically conductive material selected from the group of materials consisting of: copper, graphite, stainless steel, tungsten, mixtures thereof, and alloys thereof.

* * * * *